US010438528B2

(12) United States Patent
Lai et al.

(10) Patent No.: US 10,438,528 B2
(45) Date of Patent: Oct. 8, 2019

(54) DRIVING METHOD AND SYSTEM OF DISPLAY DEVICE WITH VIEWING ANGLE CALCULATION AND COLOR SHIFT COMPENSATION

(71) Applicant: Shenzhen China Star Optoelectronics Semiconductor Display Technology Co., Ltd., Shenzhen, Guangdong (CN)

(72) Inventors: Ching-hong Lai, Guangdong (CN); Shensian Syu, Guangdong (CN)

(73) Assignee: Shenzhen China Star Optoelectronics Semiconductor Display Technology Co., Ltd., Shenzhen, Guangdong (CN)

( * ) Notice: Subject to any disclaimer, the term of this patent is extended or adjusted under 35 U.S.C. 154(b) by 29 days.

(21) Appl. No.: 15/740,660

(22) PCT Filed: Oct. 18, 2017

(86) PCT No.: PCT/CN2017/106641
§ 371 (c)(1),
(2) Date: Dec. 28, 2017

(87) PCT Pub. No.: WO2019/006910
PCT Pub. Date: Jan. 10, 2019

(65) Prior Publication Data

US 2019/0012952 A1 Jan. 10, 2019

(30) Foreign Application Priority Data

Jul. 5, 2017 (CN) ..... 2017 1 0543373

(51) Int. Cl.
*G09G 3/20* (2006.01)
*G09G 3/22* (2006.01)
(Continued)

(52) U.S. Cl.
CPC ..... *G09G 3/2074* (2013.01); *G09G 3/22* (2013.01); *G09G 3/3607* (2013.01); *G09G 5/02* (2013.01);
(Continued)

(58) Field of Classification Search
CPC ..... G09G 3/3607; G09G 3/2074; G09G 3/22; G09G 2300/0447; G09G 2320/028;
(Continued)

(56) References Cited

U.S. PATENT DOCUMENTS 6,459,955 B1 * 10/2002 Bartsch ..... A47L 9/00 700/245
2006/0176259 A1 * 8/2006 Yamada ..... G09G 3/3607 345/88
(Continued)

FOREIGN PATENT DOCUMENTS

CN 103428404 A 12/2013
CN 105045378 A 11/2015
(Continued)

*Primary Examiner* — Darlene M Ritchie
(74) *Attorney, Agent, or Firm* — Mintz Levin Cohn Ferris Glovsky and Popeo, P.C.; Kongsik Kim; Jhongwoo Jay Peck

(57) ABSTRACT

The present disclosure discloses a driving method and system of a display device including a plurality of pixel units, wherein the driving method includes: receiving initial image data to be displayed; positioning a viewer to acquire a viewing angle of the viewer with respect to each pixel unit; performing color shift compensation for image data of a pixel unit of which the viewing angle is larger than a threshold value; and driving the display device to display an image according to the image data after compensation. The driving system includes: a data input unit for receiving initial image data to be displayed; a position detection unit for positioning a viewer; a viewing angle calculation unit for
(Continued)

calculating and acquiring a viewing angle of the viewer with respect to each pixel unit; a data compensation unit; and a data output unit.

9 Claims, 3 Drawing Sheets

(51) Int. Cl.
*G09G 3/36* (2006.01)
*G09G 5/02* (2006.01)

(52) U.S. Cl.
CPC ..... *G09G 2310/0221* (2013.01); *G09G 2310/0264* (2013.01); *G09G 2320/028* (2013.01); *G09G 2320/0242* (2013.01); *G09G 2320/068* (2013.01); *G09G 2340/06* (2013.01); *G09G 2354/00* (2013.01)

(58) Field of Classification Search
CPC ..... G09G 2320/068; G09G 2320/0242; G09G 5/02; G09G 2340/06; G09G 2310/0221; G09G 2310/0264; G09G 2354/00
See application file for complete search history.

(56) References Cited

U.S. PATENT DOCUMENTS

2010/0033473 A1* 2/2010 Hsieh ..... G09G 3/003 345/213
2010/0156774 A1* 6/2010 Broughton ..... G09G 3/2018 345/88
2010/0182336 A1* 7/2010 Haga ..... G09G 3/3607 345/593
2013/0229430 A1* 9/2013 Chen ..... G09G 5/02 345/600
2014/0218411 A1* 8/2014 Chen ..... G09G 3/3611 345/690
2017/0154563 A1* 6/2017 Lin ..... G06F 3/01

FOREIGN PATENT DOCUMENTS

CN 106898320 A 6/2017
CN 106909334 A 6/2017
CN 107230446 A 10/2017
EP 2009929 A2 12/2008

* cited by examiner

DRIVING METHOD AND SYSTEM OF DISPLAY DEVICE WITH VIEWING ANGLE CALCULATION AND COLOR SHIFT COMPENSATION

CROSS-REFERENCES TO RELATED APPLICATIONS

This application is a U.S. national phase application, pursuant to 35 U.S.C. § 371, of PCT/CN2017/106641, filed Oct. 18, 2017, designating the United States, which claims priority to Chinese Application No. 201710543373.7 filed Jul. 5, 2017. The entire contents of the aforementioned patent applications are incorporated herein by this reference.

TECHNICAL FIELD

The present disclosure relates to a technical field of display, and more particularly, relates to a driving method and system of a display device.

BACKGROUND ART

Flat panel display device has numerous advantages of a thin body, power saving and radiationless etc., thus it has been widely used. The existing flat panel display device mainly includes a Liquid Crystal Display (LCD) and an Organic Light Emitting Diode (OLED) display device.

Recently, the share proportion of the large-sized panel gradually increases in the terminal market, however, a range of viewing angle of a viewer also increases correspondingly as the size of the panel of the display device is gradually increased, thereby highlighting problem of luminance and chromaticity distortions of the panel caused by visual angle. How to solve color shift at large viewing angle of the display device is an urgent problem in the industry.

SUMMARY

With a view to the shortcomings of the prior art, the present disclosure provides a driving method and system of a display device, to solve the problem of color shift at large viewing angle of the display device.

In order to achieve the above purpose, the present disclosure adopts the following technical solutions:

a driving method of a display device which includes a plurality of pixel units, wherein the driving method includes receiving initial image data to be displayed; positioning a viewer to acquire a viewing angle of the viewer with respect to each pixel unit; performing color shift compensation for image data of a first pixel unit of which the viewing angle is larger than a threshold value; and driving the display device to display an image according to the image data after compensation.

The threshold value of the viewing angle is 0°-5°.

The viewing angle is calculated by a formula $$\gamma = \tan^{-1}\left(\frac{h}{d}\right);$$

where γ is an angle of the viewing angle, h is a distance from a projection point of the viewer on a display plane of the display device to the pixel unit, and d is a vertical distance from the viewer to the display plane of the display device.

The image displayed by the first pixel unit according to the image data after compensation corresponds to the image displayed by the first pixel unit according to the initial image data when the viewing angle is not greater than the threshold value.

Gray-scale components of RGB of the initial image data of the first pixel unit are $R_i$, $G_i$, and $B_i$, respectively, gray-scale components of RGB of the image data after compensation are $R_i'$, $G_i'$, and $B_i'$, respectively, and gray-scale increments of RGB are $\Delta R=R_i'-R_i$, $\Delta G=G_i'-G_i$ and $\Delta B=B_i'-B_i$, respectively; the gray-scale increments ΔR, ΔG and ΔB of RGB can be calculated according to formulae (I) and (II):

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}, \tag{I}$$

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}; \tag{II}$$

in formula (I) and formula (II), $$\begin{bmatrix} X_\alpha - X_\theta \\ Y_\alpha - Y_\theta \\ Z_\alpha - Z_\theta \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix}, \tag{III}$$

in formula (III), a conversion formula of converting the gray-scale values $R_i$, $G_i$ and $B_i$ into X, Y and Z in CIEXYZ color system is:

$$\begin{bmatrix} X_\gamma \\ Y_\gamma \\ Z_\gamma \end{bmatrix} = T_\gamma \times \begin{bmatrix} R_i \\ G_i \\ B_i \end{bmatrix}, \tag{IV}$$

$$T_\gamma = \begin{bmatrix} f_{X_R}(\gamma) & f_{X_G}(\gamma) & f_{X_B}(\gamma) \\ f_{Y_R}(\gamma) & f_{Y_G}(\gamma) & f_{Y_B}(\gamma) \\ f_{Z_R}(\gamma) & f_{Z_G}(\gamma) & f_{Z_B}(\gamma) \end{bmatrix}, \tag{V}$$

wherein the formula (V) is a conversion matrix where the gray-scale values $R_i$, $G_i$ and $B_i$ are converted into X, Y and Z in the CIEXYZ color system, where a function f is a known function regarding the angle γ of the viewing angle.

In the above formulae, α is an angle that is not greater than the threshold value of the viewing angle, and θ is an angle of the viewing angle that is greater than the threshold value.

The present disclosure also provides a driving system of the display device which includes a plurality of pixel unit, wherein the driving system includes: a data input unit for receiving initial image to be displayed; a position detection unit for positioning a viewer; a viewing angle calculation unit for calculating and acquiring a viewing angle of the viewer with respect to each pixel unit; a data compensation unit for performing color shift compensation to image data of a first pixel unit of which the viewing angle is greater than a threshold value, to calculate and acquire the image data after compensation; and a data output unit for outputting the image data after compensation to the pixel unit of the display device.

The position detection unit includes a camera and an infrared sensor and/or an ultrasonic sensor; and the viewing angle calculation unit calculates the viewing angle of each pixel unit according to a preset calculation formula, and the calculation formula of the viewing angle is:

$$\gamma = \tan^{-1}\left(\frac{h}{d}\right),$$

where γ is an angle of the viewing angle, h is a distance from a projection point of the viewer on a display plane of the display device to the pixel unit, d is a vertical distance from the viewer to the display plane of the display device, and the parameters h and d are acquired by detecting of the position detection unit.

The data compensation unit is preset with a threshold value of the viewing angle, and the threshold value of the viewing angle is 0°-5°.

After the data compensation unit performs color shift compensation to the image data, the image displayed by the first pixel unit according to the image data after compensation corresponds to the image displayed by the first pixel unit according to the initial image data when the viewing angle is not greater than the threshold value.

Gray-scale components of RGB of the initial image data of the first pixel unit are $R_i$, $G_i$ and $B_i$, respectively, gray-scale components of RGB of the image data after compensation are $R_i'$, $G_i'$ and $B_i'$, respectively, and gray-scale increments of RGB are $\Delta R=R_i'-R_i$, $\Delta G=G_i'-G_i$ and $\Delta B=B_i'-B_i$, respectively; and the data compensation unit calculates and acquires the gray-scale increments ΔR, ΔG and ΔB of RGB according to formulae:

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}, \quad \text{(I)}$$

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}; \quad \text{(II)}$$

in formula (I) and formula (II), $$\begin{bmatrix} X_\alpha - X_\theta \\ Y_\alpha - Y_\theta \\ Z_\alpha - Z_\theta \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix}, \quad \text{(III)}$$

in formula (III), a conversion formula of covering the gray-scale values $R_i$, $G_i$ and $B_i$ into X, Y and Z in CIEXYZ color system is:

$$\begin{bmatrix} X_\gamma \\ Y_\gamma \\ Z_\gamma \end{bmatrix} = T_\gamma \times \begin{bmatrix} R_i \\ G_i \\ B_i \end{bmatrix}, \quad \text{(IV)}$$

$$T_\gamma = \begin{bmatrix} f_{X_R}(\gamma) & f_{X_G}(\gamma) & f_{X_B}(\gamma) \\ f_{Y_R}(\gamma) & f_{Y_G}(\gamma) & f_{Y_B}(\gamma) \\ f_{Z_R}(\gamma) & f_{Z_G}(\gamma) & f_{Z_B}(\gamma) \end{bmatrix}, \quad \text{(V)}$$

wherein the formula (V) is a conversion matrix where the gray-scale values $R_i$, $G_i$ and $B_i$ are converted into X, Y and Z in the CIEXYZ color system, where a function f is a known function regarding the angle γ of the viewing angle.

In the above formulae, α is an angle that is not greater than the threshold value of the viewing angle, and θ is an angle of the viewing angle that is greater than the threshold value.

In the driving method and system of the display device provided in the embodiments of the present disclosure, the viewing angle of the viewer with respect to each pixel unit can be calculated and acquired by positioning the viewer, and the color shift compensation can be performed to the image data of the pixel unit of which the viewing angle is greater than the threshold value, thereby improving the color shift at large viewing angle of the display device effectively. As the position of the viewer changes, the method can redetermine compensation values of respective pixel units timely and rapidly, thus it has an advantage of improving color shift in real time. In addition, the method does not need to change the pixel structure of the pixel unit, it only requires adjusting driving data of the pixel unit which produces color shift according to a size of a real-time viewing angle of the viewer, and thus it has an excellent universality and is applicable to multiple types of display devices.

DETAILED DESCRIPTION OF EXEMPLARY EMBODIMENTS

Figure 1:
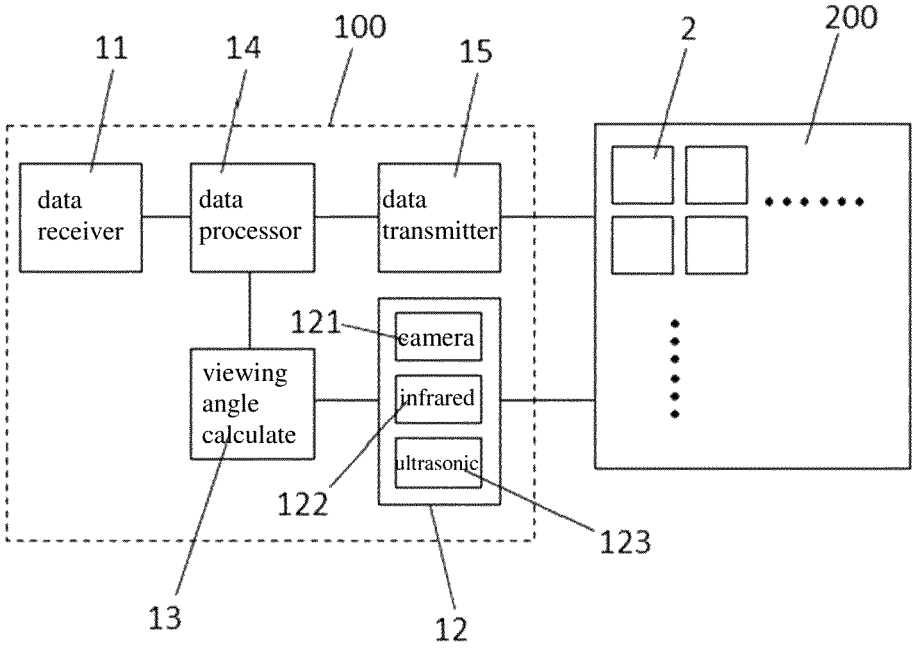
FIG. 1 is a structural diagram of a driving system of a display device provided in an embodiment of the present disclosure.

In order for the purpose, technical solution and advantages of the present disclosure to be clearer, the embodiments of the present disclosure will be further explained in detail below in conjunction with the drawings. Examples of these preferred implementations are exemplified in the drawings. The implementations of the present disclosure as shown in the drawings and as described according to the drawings are only exemplified, and the present disclosure is not limited to these implementations.

Here, it is also worthy to note that, in order to prevent the present disclosure from being obscured due to unnecessary details, the drawings only illustrate the structure and/or processing steps closely related to the solution based on the present disclosure, while other details less related to the present disclosure are omitted.

The present embodiment mainly provides a driving method of a display device for improving color shift at large viewing angle and the corresponding driving system.

As shown in FIG. 1, the display device includes a driving system 100 and a display panel 200, and the driving system 100 provides display data to the display panel 200 to drive the display panel 200 to display the corresponding image. The display panel 200 is provided with a plurality of pixel units 2 in an array.

As shown in FIG. 1, the driving system 100 of the display device in the present embodiment includes a data input unit 11, a position detection unit 12, a viewing angle calculation unit 13, a data compensation unit 14 and a data output unit 15. The data input unit 11 serves to receive initial image data to be displayed, the position detection unit 12 serves to position a viewer, the viewing angle calculation unit 13 serves to calculate and acquire a viewing angle of the viewer with respect to each pixel unit, the data compensation unit 14 serves to perform color shift compensation to image data of a first pixel unit 20 of which the viewing angle is greater than a threshold value, to calculate and acquire the image data after compensation, and the data output unit 15 serves to output the image data after compensation to the pixel unit 2 of the display panel 200.

Figure 2:
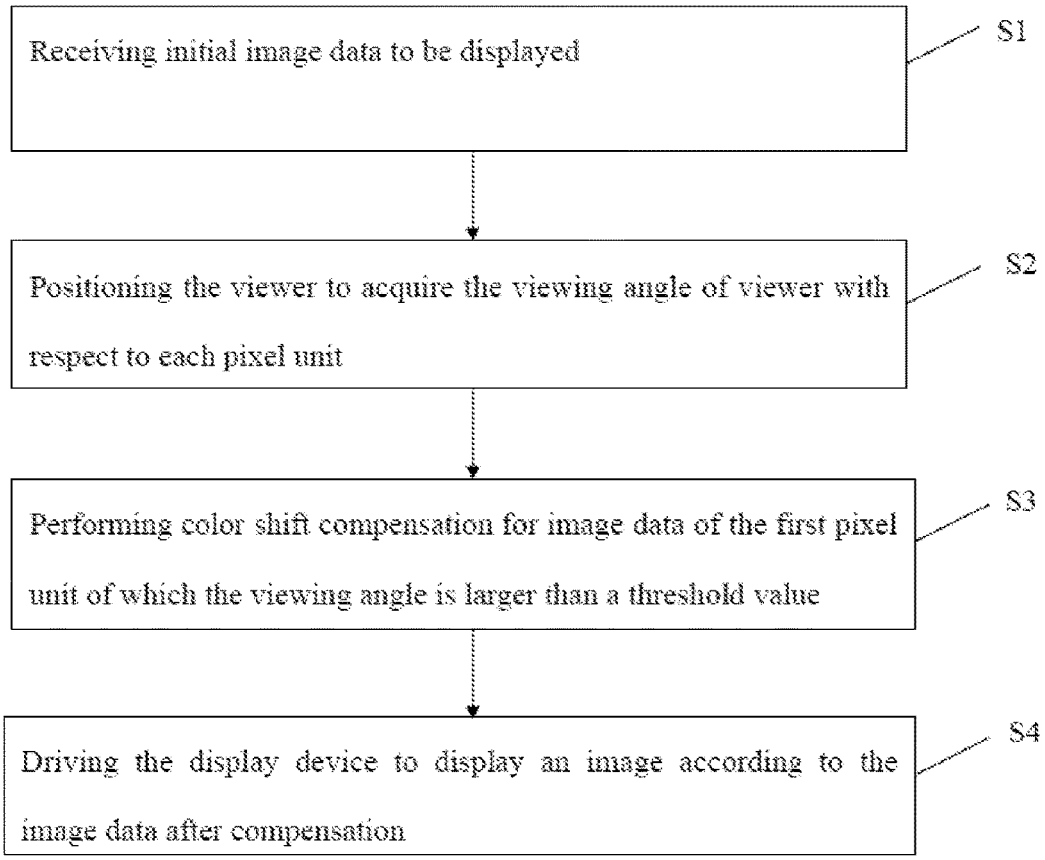
FIG. 2 is a process flowchart of a driving method of a display device provided in an embodiment of the present disclosure.

As shown in FIG. 2, the driving method of the display device in the present embodiment includes:

S1. receiving initial image data to be displayed. The initial image data to be displayed is received by the data input unit 11, generally, the initial image data refers to a gray-scale value of an image.

S2. positioning a viewer to acquire a viewing angle of the viewer with respect to each pixel unit. The viewer is positioned by the position detection unit 12, and the viewing angle calculation unit 13 calculates a viewing angle of the viewer with respect to each pixel unit 2 according to positional parameters acquired by the position detection unit 12. The viewing angle γ indicates an angle between a viewing direction of a display screen of the pixel unit and a normal direction of the pixel unit, and the viewing angle γ is calculate by a formula:

$$\gamma = \tan^{-1}\left(\frac{h}{d}\right),$$

where γ is an angle of the viewing angle, h is a distance from a projection point of the viewer on a display plane of the display device to the pixel unit 2, d is a vertical distance from the viewer to the display plane of the display device, and the parameters h and d are acquired by detecting of the position detection unit 12.

In the present embodiment, as shown in FIG. 1, the position detection unit 12 includes a camera 121, an infrared sensor 122 and an ultrasonic sensor 123, and a position of the viewer relative to the display panel 200 can be acquired by detection of using the camera 121, the infrared sensor 122 and the ultrasonic sensor 123. It should be explained that the position of the viewer in the present embodiment specifically refers to a position of eyes of the viewer. In some other embodiments, the position detection unit 12 may also include the camera 121 and the infrared sensor 122 or the ultrasonic sensor 123 only.

Further, the position detection unit 12 may be directly integrated in the display panel 200, and may also be independently disposed outside the display panel 200.

Figure 3:
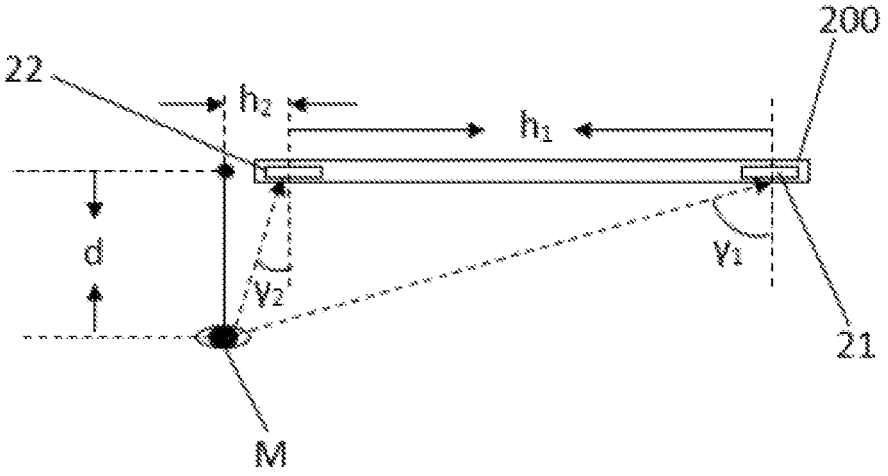
FIG. 3 is an exemplary diagram of a viewing angle of a viewer with respect to a pixel unit in an embodiment of the present disclosure.

The viewing angles of the viewer, corresponding to the pixel unit 2 at different positions in the display panel 200, are different. As shown in FIG. 3, a first pixel unit 21 and a second pixel unit 22 at different position in the display panel 200 have different viewing angles with respect to a viewer M (O is a projection point). The viewing angle corresponding to the first pixel unit 21 at one end of the display panel 200 is $$\gamma_1 = \tan^{-1}\left(\frac{h_1 + h_2}{d}\right),$$

and the viewing angle corresponding to the second pixel unit 22 at another end of the display panel 200 is $$\gamma_2 = \tan^{-1}\left(\frac{h_2}{d}\right).$$

S3. performing color shift compensation for image data of a first pixel unit of which the viewing angle is larger than a threshold value. The data compensation unit 14 serves to perform color shift compensation to image data of a first pixel unit 20 of which the viewing angle is greater than a threshold value, to calculate and acquire the image data after compensation.

Particularly, it needs to preset a threshold value $\gamma_0$ of the viewing angle in the data compensation unit 14 first, and then compare the viewing angle γ of the viewer relative to each pixel unit acquired in step S2 with the threshold value $\gamma_0$, when $\gamma > \gamma_0$, there is a need to perform color shift compensation to the pixel unit.

Taking the first pixel unit 21 and the second pixel unit 22 in FIG. 3 as an example, if the present threshold value $\gamma_0$ of the viewing angle is $\gamma_1 > \gamma_0 \geq \gamma_2$, there is a need to perform color shift compensation to the first pixel unit 21, but there is no need to perform color shift compensation to the second pixel unit 22, or in other words, the compensation value for performing color shift compensation to the second pixel unit 22 is 0.

In a preferred technical solution, the threshold value $\gamma_0$ of the viewing angle is set to within a range of 0°-5°, hereby, the viewing angle γ is smaller or equal to the threshold value $\gamma_0$, and the produced color shift is too small to be ignored. The most preferred solution is that the threshold value $\gamma_0$ is set to be 0°, that is, all the pixel units of which the viewing angle γ is not 0 need color shift compensation.

S4. driving the display device to display an image according to the image data after compensation. The data output unit 15 serves to output the image data after compensation to the pixel unit 2 of the display panel 200. It should be explained that, hereby, the image data after compensation includes image data of the pixel unit on which the color shift compensation is performed, and may also include image data of the pixel unit on which no color shift compensation is performed (or the compensation value is 0) according to the determination in S3.

Performing color shift compensation for image data of the first pixel unit of which the viewing angle is larger than the threshold value, shall be accomplished according to the following line: after the data compensation unit 14 performs color shift compensation to the image data, the image displayed by the first pixel unit according to the image data after compensation corresponds to the image displayed by the first pixel unit according to the initial image data when the viewing angle is not greater than the threshold value.

Below, there is introduced a calculation method of the compensation value for performing color shift compensation.

In the initial image data of the first pixel unit on which the color shift compensation is needed to be performed, the gray-scale components of RGB are $R_i$, $G_i$ and $B_i$, respectively, the gray-scale components of RGB of the image data after compensation are $R_i'$, $G_i'$ and $B_i'$, respectively, and the gray-scale increments of RGB are $\Delta R = R_i' - R_i$, $\Delta G = G_i' - G_i$ and $\Delta B = B_i' - B_i$, respectively. The gray-scale increments ΔR, ΔG and ΔB of RGB are compensation values for performing color shift compensation.

Particularly, the data compensation unit 14 calculates and acquires the gray-scale increments ΔR, ΔG and ΔB of RGB according to the following formulae:

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}, \quad \text{(I)}$$

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}; \quad \text{(II)}$$

in formula (I) and formula (II), $$\begin{bmatrix} X_\alpha - X_\theta \\ Y_\alpha - Y_\theta \\ Z_\alpha - Z_\theta \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix}, \quad \text{(III)}$$

in formula (III), a conversion formula of covering the gray-scale values $R_i$, $G_i$ and $B_i$ into X, Y and Z in CIEXYZ color system is:

$$\begin{bmatrix} X_\gamma \\ Y_\gamma \\ Z_\gamma \end{bmatrix} = T_\gamma \times \begin{bmatrix} R_i \\ G_i \\ B_i \end{bmatrix}, \quad \text{(IV)}$$

$$T_\gamma = \begin{bmatrix} f_{X_R}(\gamma) & f_{X_G}(\gamma) & f_{X_B}(\gamma) \\ f_{Y_R}(\gamma) & f_{Y_G}(\gamma) & f_{Y_B}(\gamma) \\ f_{Z_R}(\gamma) & f_{Z_G}(\gamma) & f_{Z_B}(\gamma) \end{bmatrix}, \quad \text{(V)}$$

wherein the formula (V) is a conversion matrix where the gray-scale values $R_i$, $G_i$ and $B_i$ are converted into X, Y and Z in the CIEXYZ color system, where a function f is a known function regarding the angle γ of the viewing angle.

In the above formulae, α is a reference viewing angle, and its value is not greater than the threshold value of the viewing angle, and θ is a viewing angle of the first pixel unit on which color shift compensation is needed to be performed, which is an angle of the viewing angle that is greater than the threshold value.

I. The derivation process of the above formula (I) is as follows:

(11) As for the first pixel unit having the viewing angle of θ, it can be calculated according to the conversion formula of covering the gray-scale values $R_i$, $G_i$ and $B_i$ into X, Y and Z in CIEXYZ color system:

$$\begin{bmatrix} X_\theta \\ Y_\theta \\ Z_\theta \end{bmatrix} = T_\theta \times \begin{bmatrix} R_i \\ G_i \\ B_i \end{bmatrix};$$

(12) Taking the first pixel unit having the viewing angle of α as a reference standard, it can be calculated according to the conversion formula of covering the gray-scale values $R_i$, $G_i$ and $B_i$ into X, Y and Z in CIEXYZ color system:

$$\begin{bmatrix} X_\alpha \\ Y_\alpha \\ Z_\alpha \end{bmatrix} = T_\alpha \times \begin{bmatrix} R_i \\ G_i \\ B_i \end{bmatrix};$$

(13) An images presented when the initial image data of the first pixel unit is $R_i$, $G_i$ and $B_i$, and the viewing angle is θ corresponds to an image presented when the initial image data of the pixel unit is $R_i$−ΔR, $G_i$−ΔG and $B_i$−ΔB and the viewing angle is α, thus the following formula can be obtained:

$$\begin{bmatrix} X_\theta \\ Y_\theta \\ Z_\theta \end{bmatrix} = T_\theta \times \begin{bmatrix} R_i \\ G_i \\ B_i \end{bmatrix} =$$

$$T_\alpha \times \begin{bmatrix} R_i - \Delta R \\ G_I - \Delta G \\ B_i - \Delta B \end{bmatrix} = T_\alpha \times \begin{bmatrix} R_i \\ G_i \\ B_i \end{bmatrix} - T_\alpha \times \begin{bmatrix} \Delta R \\ \Delta G \\ \Delta B \end{bmatrix} = \begin{bmatrix} X_\alpha \\ Y_\alpha \\ Z_\alpha \end{bmatrix} - T_\alpha \times \begin{bmatrix} \Delta R \\ \Delta G \\ \Delta B \end{bmatrix};$$

Thus, $$T_\alpha \times \begin{bmatrix} \Delta R \\ \Delta G \\ \Delta B \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix} = \begin{bmatrix} X_\alpha - X_\theta \\ Y_\alpha - Y_\theta \\ Z_\alpha - Z_\theta \end{bmatrix};$$

Formula (I) can be obtained:

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}. \quad \text{(I)}$$

In the most preferred solution, taking the first pixel unit having the viewing angle α=0 as the reference standard, the formula (I) is transformed specifically as:

$$\begin{bmatrix} \Delta R \\ \Delta G \\ \Delta B \end{bmatrix} = \begin{bmatrix} X_0 - X_\theta \\ Y_0 - Y_\theta \\ Z_0 - Z_\theta \end{bmatrix} \times T_0^{-1}.$$

II. The derivation process of the above formula (II) is as follows:

(21) As for the first pixel unit having the viewing angle of θ, it can be calculated according to the conversion formula of covering the gray-scale values $R_i$, $G_i$ and $B_i$ into X, Y and Z in CIEXYZ color system:

$$\begin{bmatrix} X_\theta \\ Y_\theta \\ Z_\theta \end{bmatrix} = T_\theta \times \begin{bmatrix} R_i \\ G_i \\ B_i \end{bmatrix};$$

(22) Taking the first pixel unit having the viewing angle of α as a reference standard, it can be calculated according to the conversion formula of covering the gray-scale values $R_i$, $G_i$ and $B_i$ into X, Y and Z in CIEXYZ color system:

$$\begin{bmatrix} X_\alpha \\ Y_\alpha \\ Z_\alpha \end{bmatrix} = T_\alpha \times \begin{bmatrix} R_i \\ G_i \\ B_i \end{bmatrix};$$

(23) An images presented when the initial image data of the first pixel unit is $R_i$, $G_i$ and $B_i$, and the viewing angle is $\alpha$ corresponds to an image presented when the initial image data of the pixel unit is $R_i+\Delta R$, $G_i+\Delta G$ and $B_i+\Delta B$ and the viewing angle is $\theta$, thus the following formula can be obtained:

$$\begin{bmatrix} X_\alpha \\ Y_\alpha \\ Z_\alpha \end{bmatrix} = T_\alpha \times \begin{bmatrix} R_i \\ G_i \\ B_i \end{bmatrix} =$$

$$T_\theta \times \begin{bmatrix} R_i + \Delta R \\ G_i + \Delta G \\ B_i + \Delta B \end{bmatrix} = T_\theta \times \begin{bmatrix} R_i \\ G_i \\ B_i \end{bmatrix} = T_\theta \times \begin{bmatrix} \Delta R \\ \Delta G \\ \Delta B \end{bmatrix} = \begin{bmatrix} X_\theta \\ Y_\theta \\ Z_\theta \end{bmatrix} = T_\theta \times \begin{bmatrix} \Delta R \\ \Delta G \\ \Delta B \end{bmatrix};$$

Thus, $$T_\theta \times \begin{bmatrix} \Delta R \\ \Delta G \\ \Delta B \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix} = \begin{bmatrix} X_\alpha - X_\theta \\ Y_\alpha - Y_\theta \\ Z_\alpha - Z_\theta \end{bmatrix};$$

Formula (II) can be obtained:

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}. \quad \text{(II)}$$

In the most preferred solution, taking the first pixel unit having the viewing angle $\alpha=0$ as the reference standard, the formula (II) is transformed specifically as:

$$\begin{bmatrix} \Delta R \\ \Delta G \\ \Delta B \end{bmatrix} = \begin{bmatrix} X_0 - X_\theta \\ Y_0 - Y_\theta \\ Z_0 - Z_\theta \end{bmatrix} \times T_\theta^{-1}.$$

It should be explained that in S2 of the driving method provided by the present embodiment, the viewing angle $\gamma$ of each pixel unit needs to be calculated, thus the calculation amount is huge, and difficulty in designing the driving system is also comparatively huge. In order to reduce the calculation amount and lower the difficulty in designing the driving system, improvements may be made according to the following manner:

Splitting the display panel 200 into a plurality of subregions, and each subregion including pixel units in m rows and n columns, where m and n are integers. For example, m and n are both integers from 4 to 10.

One pixel unit is selected in each subregion as representative, for example, a pixel unit at the middlemost of each subregion is selected as representative.

A viewing angle of the viewer with respect to the pixel unit as representative is calculated and acquired, and this viewing angle serves as a viewing angle of all the pixel units in the corresponding subregion.

By splitting the subregion, only the viewing angle of one pixel unit in the region is calculated to serve as the viewing angle of all the pixel units in the subregion, thus the calculation amount is reduce significantly, and the difficulty is reduced as well. In addition, by selecting an area (the number of the pixel units contained in the subregion) of the subregion appropriately, deviations of practical viewing angles of respective pixel units in the subregion are little, which absolutely can meet the requirement for improving color shift.

To sum up, in the driving method and system of the display device provided in the embodiments of the present disclosure, the viewing angle of the viewer with respect to each pixel unit can be calculated and acquired by positioning the viewer, and the color shift compensation can be performed to the image data of the pixel unit of which the viewing angle is greater than the threshold value, thereby improving the color shift at large viewing angle of the display device effectively. As the position of the viewer changes, the method can redetermine compensation values of respective pixel units timely and rapidly, thus it has an advantage of improving color shift in real time. In addition, the method does not need to change the pixel structure of the pixel unit, it only requires adjusting driving data of the pixel unit which produces color shift according to a size of a real-time viewing angle of the viewer, thus it has an excellent universality and is applicable to multiple types of display devices.

It should be explained that the relationship terms, such as first and second, etc., in the present text are only used for distinguishing one entity or operation from another entity or operation without requiring or implying any actual relation or sequence existing between these entities or operations. Moreover, the term "include", "contain" or any other variant means covering instead of exclusively including, so that the process, method, object or device including a series of factors not only includes those factors but also includes other factors that are not explicitly listed or further include inherent factors for this process, method, object or device. Where no more limitations are provided, the factors defined by the sentence "include one . . . " do not exclude additional identical factors existing in the process, method, object or device which includes the factors.

The above statements are only the specific embodiments of the present application, it should be pointed out that, to those ordinary skilled in the art, several improvements and polish can be made without departing from the principle of the present application, also those improvements and polish should be considered as the protection scope of the present application.

What is claimed is:

1. A driving method of a display device comprising a plurality of pixel units, the driving method comprising:

receiving an initial image data to be displayed;

positioning a viewer to acquire a viewing angle of the viewer with respect to each pixel unit;

performing a color shift compensation for image data of a first pixel unit of which the viewing angle is larger than a threshold value; and driving the display device to display an image according to the image data after compensation, wherein an image displayed by the first pixel unit according to the image data after compensation, corresponds to an image displayed by the first pixel unit according to the initial image data when the viewing angle is not greater than the threshold value, wherein gray-scale components of RGB of the initial image data of the first pixel unit are $R_i$, $G_i$ and $B_i$, respectively, gray-scale components of RGB of the image data after compensation are $R'_i$, $G'_i$ and $B'_i$, respectively, and gray-scale increments of RGB are $\Delta R=R'_i-R_i$, $\Delta G=G'_i-G_i$ and $\Delta B=B'_i-B_i$, respectively; wherein the gray-scale increments ΔR, ΔG, and ΔB of RGB is calculated and acquired according to formula (I) or formula (II):

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}; \quad \text{(I)}$$

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}; \quad \text{(II)}$$

in formula (I) and formula (II), $$\begin{bmatrix} X_\alpha - X_\theta \\ Y_\alpha - Y_\theta \\ Z_\alpha - Z_\theta \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix}, \quad \text{(III)}$$

in formula (III), a conversion formula of converting the gray-scale values $R_i$, $G_i$ and $B_i$ into X, Y and Z in CIEXYZ color system is:

$$\begin{bmatrix} X_\gamma \\ Y_\gamma \\ Z_\gamma \end{bmatrix} = T_\gamma \times \begin{bmatrix} R_i \\ G_i \\ B_i \end{bmatrix}, \quad \text{(IV)}$$

$$T_\gamma = \begin{bmatrix} f_{X_R}(\gamma) & f_{X_G}(\gamma) & f_{X_B}(\gamma) \\ f_{Y_R}(\gamma) & f_{Y_G}(\gamma) & f_{Y_B}(\gamma) \\ f_{Z_R}(\gamma) & f_{Z_G}(\gamma) & f_{Z_B}(\gamma) \end{bmatrix}, \quad \text{(V)}$$

wherein T is a conversion matrix where the gray-scale values $R_i$, $G_i$ and $B_i$ are converted into X , Y and Z in the CIEXYZ color system , where a function f is a known function regarding the angle γ of the viewing angle; and wherein in the above forumlae, α is an angle that is not greater than the threshold value of the viewing angle, and θ is an angle of the viewing angle that is greater than the threshold value.

2. The driving method of the display device of claim 1, wherein the threshold value of the viewing angle is 0° -5° .

3. The driving method of the display device of claim 1, wherein a calculation formula of the viewing angle is:

$$\gamma = \tan^{-1}\left(\frac{h}{d}\right),$$

where γ is an angle of the viewing angle, h is a distance from a projection point of the viewer on a display plane of the display device to the pixel unit, and d is a vertical distance from the viewer to the display plane of the display device.

4. A driving system of a display device comprising a plurality of pixel units, the driving system comprising a data processor configured to perform:

receiving an initial image data to be displayed;

positioning a viewer;

calculating and acquiring a viewing angle of the viewer with respect to each pixel unit;

performing a color shift compensation to image data of a first pixel unit of which the viewing angle is greater than a threshold value, to calculate and acquire the image data after compensation; and outputting the image data after compensation to the pixel unit of the display device, wherein after performing the color shift compensation to the image data, the image displayed by the first pixel unit according to the image data after compensation corresponds to the image displayed by the first pixel unit according to the initial image data when the viewing angle is not greater than the threshold value, wherein gray-scale components of RGB of the initial image data of the first pixel unit are $R_i$, $G_i$ and $B_i$, respectively, gray-scale components of RGB of the image data after compensation are $R'_i$, $G'_i$ and $B'_i$, respectfively, and gray-scale incerments of RGB are $\Delta R=R'_i-R_i$, $\Delta G=G'_i-G_i$ and $\Delta B=B'_i-B_i$, respectively; wherein the data processor calculates and acquires the gray-scale incerments ΔR, ΔG and ΔB of RGB according to the following formula (I) or formula (II):

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}; \quad \text{(I)}$$

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}; \quad \text{(II)}$$

in formula (I) and formula (II), $$\begin{bmatrix} X_\alpha - X_\theta \\ Y_\alpha - Y_\theta \\ Z_\alpha - Z_\theta \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix}, \quad \text{(III)}$$

in formula (III), a conversion formula of converting the gray-scale values $R_i$, $G_i$ and $B_i$ into X, Y and Z in CIEXYZ color system is:

$$\begin{bmatrix} X_\gamma \\ Y_\gamma \\ Z_\gamma \end{bmatrix} = T_\gamma \times \begin{bmatrix} R_i \\ G_i \\ B_i \end{bmatrix}, \quad \text{(IV)}$$

$$T_\gamma = \begin{bmatrix} f_{X_R}(\gamma) & f_{X_G}(\gamma) & f_{X_B}(\gamma) \\ f_{Y_R}(\gamma) & f_{Y_G}(\gamma) & f_{Y_B}(\gamma) \\ f_{Z_R}(\gamma) & f_{Z_G}(\gamma) & f_{Z_B}(\gamma) \end{bmatrix}, \quad \text{(V)}$$

wherein T is a conversation matrix where the gray-scale values $R_i$, $G_i$ and $B_i$ are converted into X, Y and Z in the CIEXYZ color system, where a function f is a known function regarding the angle γ of the viewing angle; and wherein in the above formulae, α is an angle that is not greater than the threshold value of the viewing angle, and θ is an angle of the viewing angle that is greater than the threshold value.

5. The driving system of the display device of claim 4, further comprising a position detection unit, wherein the position detection unit includes a camera and an infrared sensor and/or an ultrasonic sensor; and wherein the viewing angle of each pixel unit is calculated according to a preset calculation formula, and the calculation formula of the viewing angle is:

$$\gamma = \tan^{-1}\left(\frac{h}{d}\right),$$

where γ is an angle of the viewing angle, h is a distance from a projection point of the viewer on a display plane of the display device to the pixel unit, d is a vertical distance from the viewer to the display plane of the display device, and the parameters h and d are acquired by detecting of the position detection unit.

6. The driving system of the display device of claim 4, wherein the data processor is preset with a threshold value of the viewing angle, and the threshold value of the viewing angle is 0° -5° .

7. A display device comprising a driving system and a display panel, the driving system providing display data to the display panel to drive the display panel to display corresponding images, and the display panel provided with a plurality of pixel units in array, the driving system comprising a data processor configured to perform:

receiving an initial image data to be displayed;

positioning a viewer;

calculating and acquiring a viewing angle of the viewer with respect to each pixel unit;

performing a color shift compensation to image data of a first pixel unit of which the viewing angle is greater than a threshold value, to calculate and acquire the image data after compensation; and outputting the image data after compensation to the pixel unit of the display device, wherein after performing the color shift compensation to the image data, the image displayed by the first pixel unit according to the image data after compensation corresponds to the image displayed by the first pixel unit according to the initial image data when the viewing angle is not greater than the threshold value, wherein gray-scale components of RGB of the initial image data of the first pixel unit are $R_i$, $G_i$ and $B_i$, respectively, gray-scale components of RGB of the image data after compensation are $R'_i$, $G'_i$ and $B_i$, respectively, and gray-scale increments of RGB are $\Delta R=R'_i-R_i$, $\Delta G=G'_i-G_i$ and $\Delta B=B'_i-B_i$, respectively; wherein the data processor calculates and acquires the gray-scale increments ΔR, ΔG and ΔB of RGB according to the following formula (I) or formula (II):

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\alpha^{-1}; \quad \text{(I)}$$

$$\begin{bmatrix} \Delta R \\ \Delta G \\ \Delta B \end{bmatrix} = \begin{bmatrix} X_\alpha - X_\theta \\ Y_\alpha - Y_\theta \\ Z_\alpha - Z_\theta \end{bmatrix} \times T_\theta^{-1}; \quad \text{(II)}$$

in formula (I) and formula (II), $$\begin{bmatrix} X_\alpha - X_\theta \\ Y_\alpha - Y_\theta \\ Z_\alpha - Z_\theta \end{bmatrix} = \begin{bmatrix} X_\alpha \\ Y_\alpha \\ Z_\alpha \end{bmatrix} - \begin{bmatrix} X_\theta \\ Y_\theta \\ Z_\theta \end{bmatrix} \quad \text{(III)}$$

in formula (III), a conversion formula of covering the gray-scale values $R_i$, $G_i$ and $B_i$ into X, Y and Z in CIEXYZ color system is:

$$\begin{bmatrix} X_\gamma \\ Y_\gamma \\ Z_\gamma \end{bmatrix} = T_\gamma \times \begin{bmatrix} R_i \\ G_i \\ B_i \end{bmatrix}, \quad \text{(IV)}$$

$$T_\gamma = \begin{bmatrix} f_{X_R}(\gamma) & f_{X_G}(\gamma) & f_{X_B}(\gamma) \\ f_{Y_R}(\gamma) & f_{Y_G}(\gamma) & f_{Y_B}(\gamma) \\ f_{Z_R}(\gamma) & f_{Z_G}(\gamma) & f_{Z_B}(\gamma) \end{bmatrix}, \quad \text{(V)}$$

wherein T is a conversion matrix where the gray-scale values $R_i$, $G_i$ and $B_i$ are converted into X, Y and Z in the CIEXYZ color system, where a function f is a known function regarding the angle γ of the viewing angle; and wherein in the above formula, α is an angle that is not greater than the threshold value of the viewing angle, and θ is an angle of the viewing angle that is greater than the threshold value.

8. The display device of claim 7, further comprising a position detection unit, wherein the position detection unit includes a camera and an infrared sensor and/or an ultrasonic sensor; and wherein the viewing angle of each pixel unit is calculated according to a preset calculation formula, and the calculation formula of the viewing angle is:

$$\gamma = \tan^{-1}\left(\frac{h}{d}\right),$$

where γ is an angle of the viewing angle, h is a distance from a projection point of the viewer on a display plane of the display device to the pixel unit, d is a vertical distance from the viewer to the display plane of the display device, and the parameters h and d are acquired by detecting of the position detection unit.

9. The display device of claim 7, wherein the data processor is preset with a threshold value of the viewing angle, and the threshold value of the viewing angle is 0° -5° .

* * * * *